United States Patent [19]

Peletz, Jr. et al.

[11] Patent Number: 4,690,076

[45] Date of Patent: Sep. 1, 1987

[54] METHOD FOR DRYING COAL WITH HOT RECYCLE MATERIAL

[75] Inventors: Lawrence J. Peletz, Jr., East Granby; Glen D. Jukkola, Glastonbury, both of Conn.

[73] Assignee: Combustion Engineering, Inc., Windsor, Conn.

[21] Appl. No.: 848,065

[22] Filed: Apr. 4, 1986

[51] Int. Cl.[4] ..... F22B 1/00

[52] U.S. Cl. ..... 110/347; 110/106; 110/238; 110/245; 110/263

[58] Field of Search ..... 110/341, 342, 347, 245, 110/248, 224, 232, 106, 238

[56] References Cited

U.S. PATENT DOCUMENTS

| | | | |
|---|---|---|---|
| 4,059,060 | 11/1977 | Gambs et al. | 110/106 |
| 4,232,614 | 11/1980 | Fitch et al. | 110/238 |
| 4,259,911 | 4/1981 | Jones | 110/263 |
| 4,343,246 | 8/1982 | Jukkola et al. | 110/245 |
| 4,397,248 | 8/1983 | Mehta et al. | 110/106 |
| 4,411,879 | 10/1983 | Ehrlich et al. | 110/245 |
| 4,421,036 | 12/1983 | Brannstrom et al. | 110/245 |
| 4,424,766 | 1/1984 | Boyle | 110/245 |
| 4,434,726 | 3/1984 | Jones | 110/245 |
| 4,446,799 | 5/1984 | Andersen | 110/263 |
| 4,640,205 | 2/1987 | Brannstrom | 110/347 |

*Primary Examiner*—Henry C. Yuen

*Attorney, Agent, or Firm*—William W. Habelt

[57] ABSTRACT

A method of feeding particulate material (17) to a fluidized bed furnace (10) is provided wherein particulate coal, particulate limestone and particulate material withdrawn from the furnace system are fed to the furnace as a mixture in a unified feed system. Raw coal and limestone are independently crushed to the desired size and premixed to yield a desired calcium to sulfur mole ratio. The premized coal and limestone (7) are passed to a dryer/mixer and contacted therein with hot particulate material (9,19) withdrawn from the fluidized bed furnace system for a period of time sufficient to substantially dry the wet coal and hydrate at least a portion of the lime contained in the hot particulate material. The so-conditioned mixture (15) is then entrained in a conveying gas and fed to the fluidized bed (12) in a conventional manner.

3 Claims, 1 Drawing Figure

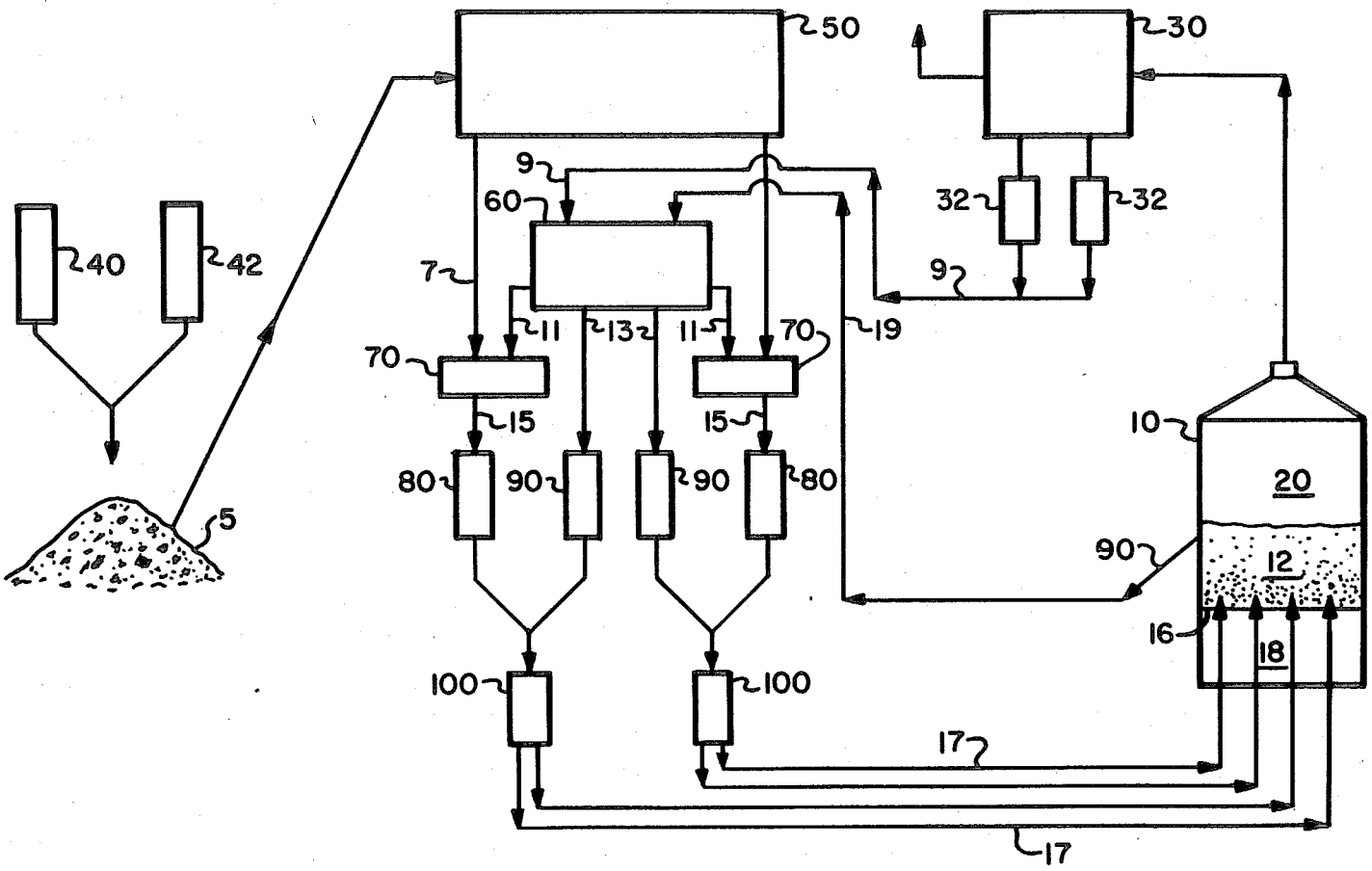
20
12
18
16
10
90
30
32
32
9
19
17
17
50
70
80
15
11
13
90
11
15
90
9
60
7
70
80
100
100
42
40
5

METHOD FOR DRYING COAL WITH HOT RECYCLE MATERIAL

BACKGROUND OF THE INVENTION

The present invention relates to fluidized bed systems and, more particularly, to a method of feeding particulate material to fluidized furnace.

In a typical present day fluidized bed furnace, particulate fuel, such as coal having a top size ranging from up to about 6.5 mm., is typically fed to and combusted within a fluidized bed of similar size particulate material at relatively low temperatures ranging from 760° C. to 925° C. Fluidized bed furnaces are particulately adaptable to burning sulfur containing fuels as the particulate material making up the bed may include a sulfur absorbent, most commonly crushed limestone, in addition to the particulate fuel. Fluidizing air, which also serves as combustion air, is supplied to the fluidized bed from a air plenum located beneath the bed support plate. The fluidizing air passes upwardly from the air plenum into the fluidized bed through a plurality of openings in the support plate at a flow rate sufficiently high to fluidize or entrain the particulate material within the fluidized bed depending upon the velocity of the fluidizing air. In a typical bubbling bed system, the velocity of the fluidizing air is controlled to fluidize, but not entrain, a majority of the particulate material in the bed. In a typical circulating fluidized bed, however, the velocity of the fluidizing air is maintained high enough to entrain most of the particulate material.

A number of different approaches have been suggested for feeding particulate material to the bed, including overbed feed systems and underbed feed systems. In typical fluidized bed furnace feed systems, whether of the overbed feed type or the underbed feed type, or a combination thereof, separate feed systems are utilized for each of the different particulate materials being supplied to the bed. Typically, limestone is crushed in the yard and transported to the boiler house where it is stored in storage silos for subsequent feeding to the fluidized bed within the furnace through either an overbed or underbed feed system. In a bubbling bed furnace, the portion of particulate material elutriated from the fluidized bed and entrained in the fluidizing gas is removed from the fluidizing gas in a mechanical collector and transported to storage tanks for recycle back to the fluidized bed. Typically this recycle material will contain partially combusted coal, commonly referred to as char, unreacted sulfur oxide absorbent, sulfate salts formed on the reaction of the absorbent with sulfur dioxides in the flue gas, and fly ash particles generated upon the combustion of the coal.

On bubbling bed furnaces, an additional feed system is typically supplied for drying and transporting crushed coal to the fluidized bed of the furnace. The coal is pneumatically transported in a stream of hot recycled flue gas from the coal crushers to a pair of cyclone separators. As the coal is transported, a major portion of the moisture associated with the coal is evaporated by flash drying in the presence of the hot flue gas. The coal is separated from the flue gas in the cyclone separators and transported on conveyers to a storage silo for subsequent feeding directly to the fluidized bed. The flue gas, together with any fine coal particles entrained therein, is vented from the cyclone separators to a bag filter wherein the fine coal particles are removed from the flue gas before the relatively clean flue gas is vented to the atmosphere. The coal fines recovered in the bag filters are conveyed to the coal storage silos for subsequent feeding to the furnace.

Of course, the provision of separate feed systems for each of the particulate materials greatly increases the complexity of the fluidized bed furnace system and it also adds significantly to the capital cost and the operating cost associated with the fluidized bed furnace system. Additionally, the drying of the wet coal by flash drying evaporation requires a significant amount of inert hot gas and a duct system which provides sufficient residence time for contact between the hot inert gas and the wet coal to permit evaporation. An inert gas, such as flue gas, must be used rather than fluidizing or combustion air as the drying gas must be unreactive with respect to the coal in order to prevent explosions. Additionally, cleanup equipment such as the cyclone separators and the bag filter system must be provided to remove the coal from the drying gas in order that the drying gas may be clean enough for venting to the atmosphere. The provision of the cleanup system, of course, increases the capital cost of the fluidized bed furnace system and complicates maintenance and operation of the fluidized bed furnace system.

One alternative to drying the wet coal with an inert gaseous medium is to dry the wet coal with an inert particulate medium. One such system is disclosed in U.S. Pat. No. 4,414,905 wherein hot particulate material is removed from the fluidized bed and contacted with wet coal in a fluidized mixer. Moisture is evaporated from the wet coal in the mixer upon contact with the hot particulate solids. The moisture evaporated from the coal is entrained in the fluidizing medium and vented from the mixer. Of course, a cleanup system would be necessary to remove any entrained particulate from the vented fluidizing medium unless the vented fluidizing medium was directed back to the combustor. The dried coal and cooled particulate material are then passed to a pneumatic feeder for conveyance to the fluidized bed within the furnace through a conventional underbed feed system.

Another method for drying wet coal with particulate material is disclosed in U.S. Pat. No. 4,411,879. As disclosed therein, the particulate material elutriated from the bed in the flue gas is removed from the flue gas in a filtering means. The particulate material is then passed from the filter means and mixed with the wet coal at a temperature from about 200 degrees F. to about 400 degrees F. As the particulate material elutriated from the bed and collected in the filtering means contains unreacted calcium oxide sulfur absorbant, a hydration reaction will occur between moisture from the wet coal and the calcium oxide to form calcium hydroxide and liberate heat which will further evaporate moisture from the coal. The dry coal and the particulate material utilized in the drying process are pneumatically conveyed from the mixing vessel to the fluidized bed furnace. Additional water may be added in the mixing vessel to provide sufficient water to fully hydrate the unreacted calcium oxide in the recycle material in the event there is insufficient moisture in the coal. Fresh limestone and additional coal are fed to the fluidized bed boiler through separate conventional feed systems.

It would be advantageous to provide a single transport system wherein the feeding of the various particulate materials to be supplied to the fluidized bed is integrated to provide a single unified particulate feed system. Such a unified particulate feed system would certainly have a lower capital cost than conventional separate feed system and would present a less complex operation procedure and simplify maintenance problems. Additionally, utilizing a unified particulate feed system wherein no gaseous fluid is utilized to dry the particulate fuel eliminates the need for a gaseous cleanup system which in turn simplifies the operation and reduces capital costs.

SUMMARY OF THE INVENTION

It is the object of the present invention to provide a unified particulate feed system for a fluidized bed furnace system for feeding the particulate fuel, the particulate sulfur absorbent, and the recycle particulate material to the bed wherein hot recycle particulate material is utilized to dry the wet particulate fuel.

In the method of feeding particulate material to a fluidized bed furnace in accordance with the present invention, raw coal and limestone are independently crushed to the desired size and then blended in predetermined portions to yield a desired calcium to sulfur mole ratio in the mixture. Additional limestone may be supplied via an overbed feed system to provide for fine tuning the in-bed sulfur absorption process. The premixed coal and limestone are passed to a dryer/mixer wherein the particulate coal and particulate limestone are contacted with hot particulate material withdrawn from the fluidized bed furnace system for a period of time sufficient to substantially dry the wet particulate coal. As the hot particulate material mixes with the particulate coal, moisture is flashed from the surface of the coal to form steam and the temperature of the mixture quickly drops to about 200 F. Additionally, as the hot particulate material withdrawn from the fluidized bed furnace system will contain unutilized lime, moisture in the wet coal will react with the lime to form hydrated lime which has a greater reactivity for sulfur absorption than unhydrated lime. Also, additional heat will be liberated during the hydration reaction which will help to further dry the wet fuel.

The conditioned mixture of dry particulate coal, particulate limestone and particulate material withdrawn from the fluidized bed system, is entrained in a conveying gas and passed to the furnace for introduction into the bed through conventional pneumatic feed systems. The conditioned mixture of dry particulate coal, particulate limestone and particulate material withdrawn from the fluidized bed furnace, is then fed to the bed in a conventional manner. The distribution of these materials within the bed, however, is greatly improved due to the fact that they are fed to the bed simultaneously as one unified stream.

During normal operation of the fluidized bed furnace, the hot particulate material withdrawn from the fluidized bed system will be taken from the particulate collector typically located downstream of the fluidized bed furnace. Particulate material entrained in the flue gas, which includes unburned coal, termed char, unutilized sulfur absorbant, and fly ash from the coal, is removed from the flue gas stream in the particulate collector. As this particulate material has been elutriated directly from a fluidized bed within the furnace chamber, this material will typically have a temperature in the range of 600 to 800 F. This hot particulate material is then mixed with the premixed coal and limestone as described above.

During startup of the fluidized bed furnace system, it is customary to heat the fluidized bed with an auxiliary fuel, typically natural gas, in order to raise the bed to a temperature where upon the supply of coal to the fluidized bed combustion will be self sustaining. In order to provide dry coal to the bed in the unified feed system of the present invention, bed material is utilized during startup as the hot particulate to dry the wet coal. Once the bed material has been heated to a temperature of about 600 F. by the auxiliary fuel, a portion of the bed material is withdrawn and mixed with the premixed coal and limestone as described hereinbefore.

BRIEF DESCRIPTION OF THE DRAWING

The features and advantages of a method for feeding particulate fuel, particulate sulfur absorbent, and particulate recycle material in accordance with the present invention will be evident from the following description of the preferred mode for carrying out the present invention and the accompanying FIGURE which is a schematic representation of a feed system adapted to carry out the method of the present invention.

DESCRIPTION OF A PREFERRED EMBODIMENT

Referring now to the drawing, there is depicted therein a fluidized bed furnace 10 of the bubbling bed type wherein a sulfur containing fuel, such as particulate coal, is combusted in a fluidized bed 12 of particulate material which includes a sulfur oxide absorbant such as limestone. Combustion air is supplied to the air plenum 18 located beneath the fluidized bed support plate 16 and passes upwardly from the air plenum 18 into the fluidized bed 12 within the combustion chamber 20 defined within the fluidized bed furnace 10 through a plurality of airports in the perforated bed support plate 16. The combustion air is supplied at a flow rate sufficiently high enough to fluidize, but not entrain, a majority of the particulate material within the fluidized bed 12. In a circulating fluidized bed furnace, the velocity of the fluidizing air is further increased to a point that a majority of the particulate material is entrained for circulation throughout the system.

The particulate coal combusts within the fluidized bed 12 and the freeboard region thereabove to form hot flue gases which pass out of the combustion chamber 20 of the fluidized bed furnace 10 to a mechanical particulate collector 30 disposed downstream of the fluidized bed furnace 10 in the flue preventing the flue gases to the atmosphere. Typically, the mechanical dust collector 30 would be a cyclone separator although it is to be understood that other particulate collectors, such as impact separators, inertial classifiers, and centrifugal classifiers, or combinations thereof, may be utilized. Typically, steam generating surface, not shown, would be disposed in the flue upstream and/or downstream of the mechanical dust collector 30 to cool the hot flue gases being vented from the combustion chamber 20 of the fluidized bed furnace 10 prior to admission to the atmosphere. Additionally, a fine particulate collection device, most commonly a bag filter type collector, would usually be disposed downstream of the mechanical dust collector 30 to remove fine particulate material that remains entrained in the flue gas passing from the mechanical dust collector 30 prior to admission of the flue gas to the atmosphere. The fine particulate material would predominantly comprise fly ash and sulfated absorbant particles, but little unburned fuel particles, and would therefore be disposed of rather than recycled to the furnace.

The particulate material removed from the flue gas in the mechanical dust collector 30 would comprise the relatively coarse fraction of particulate material contained in the flue gas passing from the combustion chamber 20 and would therefore have a sufficiently high content of unburned fuel that it is economical to recycle back to the fluidized bed furnace. Additionally, the particulate material separator from the flue gas in the mechanical dust collector 30 would contain substantial unreacted sulfur absorbent in addition to fly ash generated by the combustion of the coal and sulfated absorbent particles. Due to its content of unburned fuel and unreacted sulfur absorbent, the particulate material collected in the 30 is recycled back to the fluidized bed furnace 10.

Depicted in the drawing alongside the fluidized bed furnace 10 is a feed system for supplying coal, limestone, and recycle material to the fluidized bed furnace 10 design in accordance with the method of the present invention. Raw coal to be combusted in the furnace 20 and raw limestone to serve as the sulfur absorbent in the fluidized bed furnace 10 are independently crushed in crushers 40 and 42, respectively, to a top size in the range of 3.0 to 6.5 mm. The crushed coal and crushed limestone are then blended in predetermined proportions to yield a desired calcium to sulfur mole ratio depending upon the nature of fuel being burned, the sulfur content of the fuel, the particular absorbent being used, and whether the furnace is a bubbling fluidized bed or circulating fluidized bed. Preferably, an additional portion of the crushed limestone, preferably that which is oversized, is not mixed with the crushed coal in the yard but rather is transported to storage tanks, now shown, in the vicinity of the fluidized bed furnace 10 for supply to the fluidized bed 12 through an overbed feed system as a method of fine tuning the overall calcium to sulfur ratio within the fluidized bed 12 at any given time. Preferably, the sulfur-bearing coal and limestone are premixed selectively to provide a calcium to sulfur mole ratio in the mixture ranging from 50% to about 90% of the desired overall ratio of calcium to sulfur ratio. The premixed crushed coal and crushed limestone is typically stored in the coal yard until needed and then transported to a coal/limestone storage bunker 50 disposed in the more immediate vicinity of the furnace 10.

The premixing of the wet crushed coal and the crushed limestone in accordance with Applicant's invention has been found to enhance the flowability and conveyability of the coal through the feed system. In the past, the conveying of wet crushed coal has presented problems in that the crushed coal, due to its moisture content, would often cake and clog the feed systems. By mixing the crushed limestone with the wet crushed coal, the wet coal does not tend to cake to the extent experienced in coal only streams and therefore the flowability and conveyability of the wet coal has been enhanced.

Hot particulate material 9 collected from the mechanical particulate collector 30 is fed by pneumatic transport, by conveyor, or by gravity from the surge hopper 32 to a recycle material distribution tank 60. A first portion 11 of the hot recycle particulate is passed from the distribution tank 60 to one or more dryers 70 wherein it is thoroughly mixed and contacted with the wet particulate coal and particulate limestone mixture 7 which is supplied to the dryers 70 from the storage bunker 50. The hot recycle material 11 is blended with the wet particulate coal and limestone mixture 7 in the dryer 70 in an amount sufficient to adequately dry the wet coal. It is contemplated that the amount of hot recycle material 11, which is typically supplied to the dryer 70 from the recycle distribution tank 60 at a temperature ranging from 400 to 700 F. depending upon furnace load, will be less than about one pound of recycle particulate to two pounds of wet coal. The wet particulate coal and particulate limestone mixture 7 is supplied to the dryer 70 at ambient temperature. When the hot recycle particulate material 11 is mixed with the ambient coal and limestone mixture 7, the temperature of the resultant overall mixture quickly drops to about 200 F. because of the rapid flashing of water on the surface of the wet particulate coal to steam. Additionally, water on the surface of the wet coal also reacts with unreacted calcium oxide and calcium sulfate particles present in the hot recycle material 11 to hydrate those particles to produce calcium hydroxide, plaster of paris, and gypsum. These particulate materials are dry and easily handled and serve to further enhance the flowability and conveyability of the resultant mixture over that experienced with coal alone. Further, as the hydration reactions between the water and the calcium oxide and calcium sulfate particles are exothermic, additional heat is made available for drying the wet coal.

The drying process is regulated by monitoring the temperature of the overall mixture of dried particulate coal, particulate limestone, and cooled particulate recycle material 15 produced in the dryer 70. The temperature of the resultant mixture 15 is controlled by regulating the feed rate of the hot particulate recycle material 11 from the recycle distribution tank 60 to the dryer 70. If it is desired to increase the temperature of this mixture, the feed rate of recycle material to the dryer is increased. Conversely, if it is desired to decrease the temperature of the mixture, the feed rate of hot particulate recycle material 11 to the dryer 70 is accordingly decreased.

As more hot particulate recycle material is generally available than is necessary to dry the wet particulate coal in the dryer 70, and as it is economically desirable to recover the unburned fuel and utilize the unreacted sulfur absorbent present in the particulate material 9 separated from the flue gas in the mechanical particulate collector 30, additional recycle material 13 is passed from the recycle distribution tank 60 to recycle lock hoppers 90 for subsequent supply to the feeders 100. Additionally, as it is improbable that the furnace 10 will be able to accommodate complete recycle of the particulate material 9 under all circumstances, any excess recycle material may be drained from the recycle distribution tank 60 through a slip stream for disposal.

To supply particulate material to the fluidized bed 12 of the furnace 10, the product mixture 15 of dry particulate coal, particulate limestone, and cool particulate recycle material is passed to the recycle lock hoppers 80 and withdrawn therefrom as needed for passing to one or more pneumatic feeders 100. Additional recycle material 13 is passed as desired from the recycle lock hoppers 90 to one or more pneumatic feeders 100. In the pneumatic feeders 100, the conditioned particulate material 17, which now includes dry particulate fuel, particulate limestone, and cooled particulate material from the recycle lock hoppers 80, and hot recycle particulate material from the recycle lock hoppers 90, is entrained in a conveying gas, typically a portion of the combustion air to be supplied to the furnace 10, conveyed pneumatically to the fluidized bed furnace 10, and supplied to the fluidized bed 12 established within the combustion chamber 20 of the fluidized bed furnace 10 through conventional apparatus, typically an underbed feed system wherein a plurality of individual nozzles are fed through independent lines connected to the feeders 100.

In a further aspect of the present invention, provision is provided for drying the wet particulate coal to be supplied to the fluidized bed furnace 10 under startup conditions. When the fluidized bed furnace 10 is starting after a sufficiently prolonged downtime such that the material within the bed 12 has cooled, hot gas generators are operated to warm air which is passed through the bed to warm the bed to a temperature of about 1000 F. before particulate fuel is supplied to the bed. It is necessary to raise the temperature of the particulate material resident within the bed 12 to this level prior to supplying coal to the bed in order to ensure that the combustion of the coal within the bed will be self sustaining. Once the resident bed material reaches a temperature of about 600 F., a portion 19 of the particulate resident within the bed 12 is drained therefrom and transported pneumatically to the recycle distribution tank 60 to serve as the hot recycle particulate material 11 to be mixed with the wet particulate coal and particulate limestone mixture 7 supplied to the dryer 70 from the bunker 50.

In this manner the wet particulate coal can be dried and supplied to the fluidized bed furnace 10 for combustion therein prior to any hot recycle particulate material 9 being made available to the system by removal from the hot flue gases in the mechanical particulate collector 30. Once a sufficient supply of hot recycle particulate material 9 has been removed from the flue gas stream passing through the mechanical particulate collector 30, the feed of hot particulate recycle material 9 from the surge hoppers 32 to the recycle distribution tank 60 is commenced and the flow of hot particulate material 19 from the bed 12 is reduced. Once the amount of hot particulate material 9 being removed from the flue gas in the mechanical particulate collector 30 is sufficient to continuously supply the amount of hot particulate material required to sufficiently dry the wet coal in the dryer 70, the flow of hot particulate 19 drained from the bed 12 can be terminated.

Feeding particulate material to the fluidized bed furnace in accordance with the method of the present invention provides several advantages. Premixing of the wet crushed coal and the crushed limestone improves material handling characteristics thereby enhancing the flowability and conveyability of the coal. The drying of the wet crushed coal with hot particulate recycle material eliminates the need for expensive filtering equipment to remove fine coal entrained in the drying gases in the systems of the prior art. Further, calcium utilization should be improved as the unreacted calcium oxide in the hot recycle material should exhibit improved reactivity after undergoing hydration in the coal drying process. Also, feeding the required particulate materials to fluidized bed through a single unified feed system eliminates significant capital costs associated with providing separate feed systems for each particulate material and greatly simplifies plant maintenance. Additionally, feeding the dry coal to the fluidized bed in intimate contact with the calcium absorbent, which includes the more reactive hydrated lime, should improve the sulfur dioxide absorption efficiency thereby reducing absorbant requirements as the sulfur absorbant will be in intimate contact with the combusting coal particles within the bed.

Although the feed method of the present invention has been illustrated in the drawing, and described herein as associated with a bubbling bed-type furnace, the method of the present invetion may be readily applied to the other types of fluidized beds, such as circulating fluidized beds, by those skilled in the art. Accordingly, it is intended that the illustration of the method of the present invention with respect to a bubbling fluidized bed not be considered in any way a limitation on the scope of the invention.

We claim:

1. A method for feeding particulate fuel, particulate sulfur absorbant, and particulate recycle material to a fluidized bed furnace system having a combustion chamber housing a bed of said particulates wherein the particulate fuel is combusted to produce hot gases, a flue through which the gases are vented to the atmosphere, and a mechanical particulate collector disposed in the flue for removing particulates entrained in the gases prior to venting the gases to the atmosphere, said method comprising:

a. premixing at ambient temperature a supply of wet raw particulate fuel comprising crushed raw sulfur-bearing coal to be combusted with a supply of raw particulate sulfur absorbent comprising crushed raw limestones to form a flowable mixture thereof, the crushed raw sulfur-bearing coal and the crushed raw limestone being selectively premixed to provide a calcium to sulfur mole ratio ranging from about 50% to about 90% of the desired overall calcium to sulfur mole ratio;

b. blending the mixture of wet raw particulate fuel and raw particulate sulfur absorbent in a first mixing apparatus with a first portion of hot particulate recycle material withdrawn from the fluidized bed furnace system at a temperature ranging from about 400 F. to about 700 F. at a controlled rate so as to contact the wet raw particulate coal with the hot particulate recycle material at a ratio ranging from 0.1 to about 1.0 pounds of hot particulate material per pound of particulate fuel thereby substantially drying the wet raw particulate coal;

c. monitoring the temperature of the resultant mixture of dried raw crushed coal, raw crushed limestone, and cooled particulate recycle material leaving the first mixing apparatus;

d. selectively adjusting the controlled rate at which the first portion of the hot particulate material is blended with the mixture of wet raw crushed coal and raw crushed limestone so as to maintain the temperature of the resultant mixture within a preselected temperature range;

e. blending a second portion of the hot particulate recycle material withdrawn from the fluidized bed furnace system in a second mixing apparatus with the resultant mixture of dried raw crushed coal, raw crushed limestone, and cooled particulate recycle material after leaving the first mixing apparatus; and f. entraining the mixture of dried raw particulate coal, raw particulate sulfur absorbent and particulate recycle material withdrawn from the fluidized bed furnace system in a conveying gas for introduction into the conbustion chamber of the fluidized bed furnace system.

2. A method as recited in claim 1 wherein the hot particulate recycle material withdrawn from the fluidized bed furnace system comprises hot particulates separated from the hot gases traversing the mechanical particulate collector.

3. A method as recited in claim 1 wherein the hot particulate recycle material withdrawn from the fluidized bed furnace system comprises particulate material withdrawn from the fluidized bed at a temperature ranging from about 400 F. to about 700 F.

* * * * *